US009199788B2

(12) United States Patent
Kochanowski

(10) Patent No.: US 9,199,788 B2
(45) Date of Patent: Dec. 1, 2015

(54) DOOR ASSEMBLY FOR FREIGHT CONTAINER

(76) Inventor: George E. Kochanowski, Springboro, OH (US)

( * ) Notice: Subject to any disclaimer, the term of this patent is extended or adjusted under 35 U.S.C. 154(b) by 108 days.

(21) Appl. No.: 14/238,881

(22) PCT Filed: Aug. 14, 2012

(86) PCT No.: PCT/US2012/050682

§ 371 (c)(1),
(2), (4) Date: Apr. 14, 2014

(87) PCT Pub. No.: WO2013/025667

PCT Pub. Date: Feb. 21, 2013

(65) Prior Publication Data

US 2014/0231422 A1 Aug. 21, 2014

Related U.S. Application Data

(60) Provisional application No. 61/575,199, filed on Aug. 15, 2011.

(51) Int. Cl.
*B65D 90/54* (2006.01)
*B65D 90/00* (2006.01)
(Continued)

(52) U.S. Cl.
CPC ..... *B65D 90/008* (2013.01); *E05D 3/06* (2013.01); *E05D 3/08* (2013.01); *E05D 11/1007* (2013.01);
(Continued)

(58) Field of Classification Search
CPC ..... F25D 2323/022; E05Y 2900/516; E05Y 2900/51; E05D 3/12; E05D 3/127; E05D 3/08; E05D 3/06; E05D 11/10; E05D 11/1007; E05D 15/54; E05D 15/502; E05D 15/505; B65D 88/121; B65D 88/54; B65D 88/524; B65D 90/008
USPC ..... 220/1.5, 6, 7, 4.28; 16/230, 231
See application file for complete search history.

(56) References Cited

U.S. PATENT DOCUMENTS 1,377,382 A 5/1921 Wyman
1,609,259 A 11/1926 Macnider et al.
(Continued)

FOREIGN PATENT DOCUMENTS

DE 10141791 3/2003
DE 202009004012 9/2010
(Continued)

OTHER PUBLICATIONS

PRIYO, "Maximizing Space," Innovation, Issue 10, Sep. 2008, 7 pp.
(Continued)

*Primary Examiner* — Anthony Stashick
*Assistant Examiner* — Mollie Llewellyn
(74) *Attorney, Agent, or Firm* — Brooks, Cameron & Huebsch, PLLC

(57) ABSTRACT

The present disclosure provides a hinge, a freight container that includes the hinge and a freight container that includes a locking rod and optionally the hinge. The hinge includes a locking pin, a first wing, a second wing and a first hinge pin that pivotally connects the first wing to the second wing. The hinge further includes a pair of hinge lugs each having a first set of surfaces defining openings through which a second hinge pin passes and at least one of the pair of hinge lugs having a surface defining an opening through which a locking pin reversibly travels. The locking rod is mounted to the door of the freight container, where the locking rod includes a cam that can move between a first predetermined position where the cam can engage the cam keeper and a second predetermined position where the cam is disengaged from the cam keeper and can travel past the end frame of the freight container and the cam keeper as the door travels into the volume of the freight container.

19 Claims, 12 Drawing Sheets

(51) Int. Cl.

| | |
|---|---|
| ***E05D 3/08*** | (2006.01) |
| ***E05D 11/10*** | (2006.01) |
| ***E05D 3/06*** | (2006.01) |
| *E05D 3/12* | (2006.01) |
| *B65D 88/12* | (2006.01) |
| *E05B 83/10* | (2014.01) |

(52) U.S. Cl.
CPC ..... *B65D 88/121* (2013.01); *E05B 83/10* (2013.01); *E05D 3/12* (2013.01); *E05D 3/127* (2013.01); *E05Y 2900/51* (2013.01); *E05Y 2900/516* (2013.01); *E05Y 2900/604* (2013.01)

(56) References Cited

U.S. PATENT DOCUMENTS

| | | | |
|---|---|---|---|
| 1,686,222 | A | 10/1928 | Adler |
| 2,142,305 | A | 1/1939 | Davis |
| 2,232,346 | A | 2/1941 | Sikes |
| 2,361,743 | A | 10/1944 | Butler |
| 2,741,391 | A | 4/1956 | Belanger |
| 2,761,581 | A | 9/1956 | Cohee |
| 2,868,407 | A | 1/1959 | Woodcock |
| 3,004,682 | A | 10/1961 | Bertolini et al. |
| 3,078,957 | A | 2/1963 | Larson |
| 3,128,897 | A | 4/1964 | Wilkins |
| 3,398,850 | A | 8/1968 | Kennard |
| 3,403,806 | A | 10/1968 | Pohl |
| 3,410,328 | A | 11/1968 | Sasai |
| 3,480,174 | A | 11/1969 | Sherwood |
| 3,570,698 | A | 3/1971 | Dougherty |
| 3,612,330 | A | 10/1971 | Baer |
| 3,612,338 | A | 10/1971 | Ekman |
| 3,684,122 | A | 8/1972 | Bonomi |
| 3,752,349 | A | 8/1973 | Rana |
| 3,765,556 | A | 10/1973 | Baer |
| 3,907,147 | A | 9/1975 | Goobeck |
| 3,937,363 | A | 2/1976 | Anderson |
| 4,112,635 | A | 9/1978 | Rylander |
| 4,122,638 | A | 10/1978 | O'Brian et al. |
| 4,191,419 | A | 3/1980 | Kirkpatrick |
| 4,214,669 | A | 7/1980 | McQuiston |
| 4,577,772 | A | 3/1986 | Bigliardi |
| 4,793,507 | A | 12/1988 | Delplanque |
| 5,107,639 | A | 4/1992 | Morin et al. |
| 5,190,179 | A | 3/1993 | Richter et al. |
| 5,257,830 | A | 11/1993 | Pflueger |
| 5,501,353 | A | 3/1996 | Warren |
| 5,878,903 | A | 3/1999 | Ung |
| 5,890,612 | A | 4/1999 | Coppi |
| 6,032,815 | A | 3/2000 | Elstone |
| 6,108,982 | A | 8/2000 | Davison |
| 6,109,469 | A | 8/2000 | Clive-Smith |
| 6,112,929 | A | 9/2000 | Ota |
| 6,164,476 | A | 12/2000 | Rene et al. |
| 6,182,849 | B1 | 2/2001 | Elstone, Sr. |
| 6,299,009 | B1 | 10/2001 | Ryziuk et al. |
| 6,357,194 | B1 | 3/2002 | Jones, Jr. |
| 7,296,704 | B2 | 11/2007 | Ferrini |
| 7,703,632 | B2 | 4/2010 | Kochanowski |
| 2006/0016807 | A1 | 1/2006 | Hsu et al. |
| 2008/0029508 | A1 | 2/2008 | Kochanowski |
| 2010/0089917 | A1 | 4/2010 | Gilbert et al. |
| 2010/0213317 | A1* | 8/2010 | Wagner et al. ..... 244/129.5 |
| 2010/0292063 | A1 | 11/2010 | Chawia et al. |

FOREIGN PATENT DOCUMENTS

| | | |
|---|---|---|
| EP | 0832825 | 4/1998 |
| EP | 1702864 | 9/2006 |
| GB | 2450676 | 1/2009 |
| JP | 2002160793 | 6/2002 |
| JP | 2002264993 | 9/2002 |
| WO | 2006024104 | 3/2006 |

OTHER PUBLICATIONS

International Search Report and Written Opinion of international application No. PCT/US2012/050682, mailed Jan. 23, 2014, 16 pp.

* cited by examiner

DOOR ASSEMBLY FOR FREIGHT CONTAINER

This application is a National Stage Application under 35 USC §371 of International Application Number PCT/US2012/050682, filed Aug. 14, 2012 and published as WO 2013/025667 on Feb. 21, 2013, which claims the benefit to U.S. Provisional Application 61/575,199, filed Aug. 15, 2011, the entire contents of which are incorporated herein by reference in its entirety.

This application claims the benefit under 35 U.S.C. §119 (e) of U.S. Provisional Patent Application No. 61/575,199, filed Aug. 15, 2011, which is incorporated herein by reference in its entirety.

FIELD OF DISCLOSURE

Embodiments of the present disclosure are directed to a freight container; more specifically, embodiments are directed to a door assembly for the freight container.

BACKGROUND

Freight containers are used for transferring goods from one location to another location. Freight containers may be transferred via a number of different modes such as, overseas transfer, rail transfer, air transfer, and trailer (e.g., tractor trailer) transfer.

To help improve efficiencies freight containers have been standardized. One such standardization is overseen by the International Organization for Standardization, which may be referred to as "ISO." The ISO publishes and maintains standards for freight containers. These ISO standards for freight containers help provide that each freight container has similar physical properties. Examples of these physical properties include, but are not limited to, width, height, depth, base, maximum load, and shape of the cargo containers.

SUMMARY

One or more embodiments of the present disclosure provide a hinge having a first wing; a first hinge pin; a second wing having a first planar portion with a first end and a second end and a second planar portion that extends perpendicular from the first end of the first planar portion, where the first hinge pin pivotally connects the first wing to the second end of the first planar portion; and a pair of hinge lugs extending from the second planar portion, the hinge lugs each having a first set of surfaces defining openings through which a second hinge pin passes and at least one of the pair of hinge lugs having a surface defining an opening through which a locking pin travels.

The second planar portion of the second wing has a first major surface and a second major surface opposite the first major surface, where the pair of hinge lugs extends from the first major surface of the second planar portion. The first wing has a first major surface and a second major surface opposite the first major surface, and where in a first predetermined position the first wing is perpendicular to the first planar portion of the second wing and the first major surface of the first wing is directly opposite and parallel with the second major surface of the second planar portion. The first wing has a first end and a second end, and where the first hinge pin pivotally connects the first end of the first wing to the second end of the first planar portion. The second planar portion has an end that is distal to the first end of the first planar portion, and the pair of hinge lugs extending from the second planar portion has a first peripheral edge, where the end of the second planar portion and the first peripheral edge of the hinge lugs lay in a common plane.

One or more embodiments of the present disclosure further provide a freight container that includes a roof structure; a floor structure opposite the roof structure; sidewall structures between the floor structure and the roof structure, each of the sidewall structures having an exterior surface and an interior surface, where the interior surface at least partially defines a volume of the freight container; an end frame joined with the roof structure, the floor structure and the sidewall structures, where the end frame has a door sill, a door header and corner posts between the door sill and the door header; a hinge on each of the corner posts, the hinge having a first wing, a first hinge pin, and a second wing, where the first wing is fastened to the corner post, the second wing has a first planar portion with a first end and a second end and a second planar portion that extends perpendicular from the first end of the first planar portion, where the first hinge pin pivotally connects the first wing fastened to the corner post to the second end of the first planar portion; a pair of hinge lugs extending from the second planar portion, the hinge lugs each having a first set of surfaces defining openings through which a second hinge pin passes and at least one of the pair of hinge lugs having a surface defining an opening through which a locking pin travels; a pair of seating blocks fastened to the end frame to form a socket that receives and seats the second planar portion and at least a portion of the pair of hinge lugs, at least one of the pair of seating blocks having a surface defining an opening through which the locking pin travels to lock and un-lock the second wing from the corner post of the freight container; and a door joined to the pair of hinge lugs with the second hinge pin, where the door pivots on the second hinge pin relative the pair of hinge lugs when the hinge lugs are locked to the corner post of the freight container to allow the door to extend adjacent the exterior surface of the sidewall structure, and where the door and the second wing pivot on the first hinge pin when the hinge lugs are un-locked to the corner post of the freight container to allow the door to travel into the volume of the freight container and extend adjacent the interior surface of the sidewall structure.

The pair of seating blocks includes a lower seating block and an upper seating block, and the pair of hinge lugs includes a lower hinge lug and an upper hinge lug, where the lower hinge lug seats on the lower seating block and the upper seating block has the surface defining the opening through which the locking pin travels through the opening of the pair of hinge lugs to lock and un-lock the second wing from the corner post of the freight container. The lower seating block includes a first surface on which the lower hinge lug seats a second surface substantially perpendicular to the first surface, and a third surface that slopes between the first surface and the second surface, where the lower hinge lug travels along the third surface as the second wing pivots around the first hinge pin relative the first wing. The upper seating block includes a first surface, a second surface substantially perpendicular to the first surface, and a third surface that slopes between the first surface and the second surface, where the second planar portion travels along the third surface as the second wing pivots around the first hinge pin relative the first wing.

Each of the lower hinge lug and the upper hinge lug include a surface defining an opening through which the locking pin travels, and each of the lower seating block and the upper seating block include a surface defining an opening through which the locking pin travels to lock and un-lock the second wing from the corner post of the freight container. The end frame can include a locking pin travel stop to limit a travel distance of the locking pin. For the various embodiments, the locking pin has a surface defining a structure on which a tool can be used to cause the locking pin to travel. The locking pin secures the hinge perpendicular to an axis of rotation of the second hinge pin. The door can further include an axle and a wheel, where the wheel is positioned between the door and the floor structure to support and guide the door as the door travels into the volume of the freight container. The sidewall structures can include a latch, where the latch engages and releasable holds the door adjacent the interior surface of the sidewall structure.

A locking rod is mounted to the door, the locking rod having a first portion and a second portion joined to the first portion with a connection shaft, where the first portion and the second portion telescope relative the connection shaft to change a length of the locking rod. The connection shaft can have a polygonal cross-sectional shape. The locking rod has a handle and each of the first portion and the second portion of the locking rod has a cam, where the cam engages and disengages a cam keeper mounted to the end frame of the freight container as the handle turns the locking rod. The locking rod travels past the end frame and the cam keeper as the door travels into the volume of the freight container. The door can further include stops that limit the degree of travel of the locking rod.

One or more embodiments of the present disclosure further provide a freight container that includes a roof structure; a floor structure opposite the roof structure; sidewall structures between the floor structure and the roof structure, each of the sidewall structures having an exterior surface and an interior surface, where the interior surface at least partially defines a volume of the freight container, an end frame joined with the roof structure, the floor structure and the sidewall structures, the end frame having a cam keeper; a door joined to the end frame, where the door can move relative the end frame to travel into the volume of the freight container; and a locking rod mounted to the door, where the locking rod includes a cam that can move between a first predetermined position where the cam engage the cam keeper and a second predetermined position where the cam is disengaged from the cam keeper and travels past the end frame and the cam keeper as the door travels into the volume of the freight container.

The door of the freight container can include a locking rod with a handle and a cam, where the cam engages and disengages a cam keeper mounted to the end frame of the freight container as the handle turns the locking rod; and an anti-racking support extending away from a peripheral edge of the door, where the anti-racking support is directly adjacent the corner post when the cam is engaged with the cam keeper. The anti-racking support can be directly adjacent both the hinge and the corner post when the cam is engaged with the cam keeper. The anti-racking support has a first surface that is directly adjacent the second wing of the hinge and a second surface parallel to the first surface that is directly adjacent a U-channel of the corner post when the cam is engaged with the cam keeper. The door can further include an anti-racking block having a tab and a slot to releasably receive the tab, and where the freight container includes a first and a second of the door, with the tab extending from the first of the door and the slot extending from the second of the door such that the tab seats completely within the slot when the cam of each of the first of the door and the second of the door are engaged with their respective cam keeper.

The freight container can also include a roof structure, a floor structure opposite the roof structure, sidewall structures between the floor structure and the roof structure, an end frame having a corner post, the end frame joined with the roof structure, the floor structure and the sidewall structures, a door joined to the corner post with a hinge, the hinge having a locking pin, a first wing, a first hinge pin, a second hinge pin, and a second wing, where the first wing is fastened to the corner post, the second wing has a first planar portion with a first end and a second end and a second planar portion that extends perpendicular from the first end of the first planar portion, where the first hinge pin pivotally connects the first wing fastened to the corner post to the second end of the first planar portion, a pair of hinge lugs extending from the second planar portion, the hinge lugs each having a first set of surfaces defining openings through which the second hinge pin passes, where the door pivots on the second hinge pin relative the pair of hinge lugs when the hinge lugs are locked to the corner post of the freight container with the locking pin to allow the door to extend adjacent the exterior surface of the sidewall structure, and where the door and the second wing pivot on the first hinge pin when the hinge lugs are un-locked to the corner post of the freight container to allow the door to travel into the volume of the freight container and extend adjacent the interior surface of the sidewall structure, and an anti-racking support including a first lug, a second lug and a mounting support fastened to the door, where the first lug and the second lug extend from the mounting support in a common direction to extend from a peripheral edge of the door.

The hinge can also include a locking pin, a first wing, a first hinge pin, a second wing having a first planar portion with a first end and a second end and a second planar portion that extends perpendicular from the first end of the first planar portion, where the first hinge pin pivotally connects the first wing to the second end of the first planar portion, a second hinge pin, and a pair of hinge lugs extending from the second planar portion, the hinge lugs each having a first set of surfaces defining openings through which the second hinge pin passes and the first wing and the second planar portion of the second wing each include a surface that defines an opening through which the locking pin reversibly travels.

The freight container can also include a corner post having a J-bar and a U-channel, an H-Block positioned between the J-bar and the U-channel of the corner post, where edges of the U-channel abut the H-Block, and a hinge coupled to the corner post, where the use of the H-Block protects the hinge from forces transmitted through the corner post.

The above summary of the present disclosure is not intended to describe each disclosed embodiment or every implementation of the present disclosure. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

DETAILED DESCRIPTION

Figure 1:
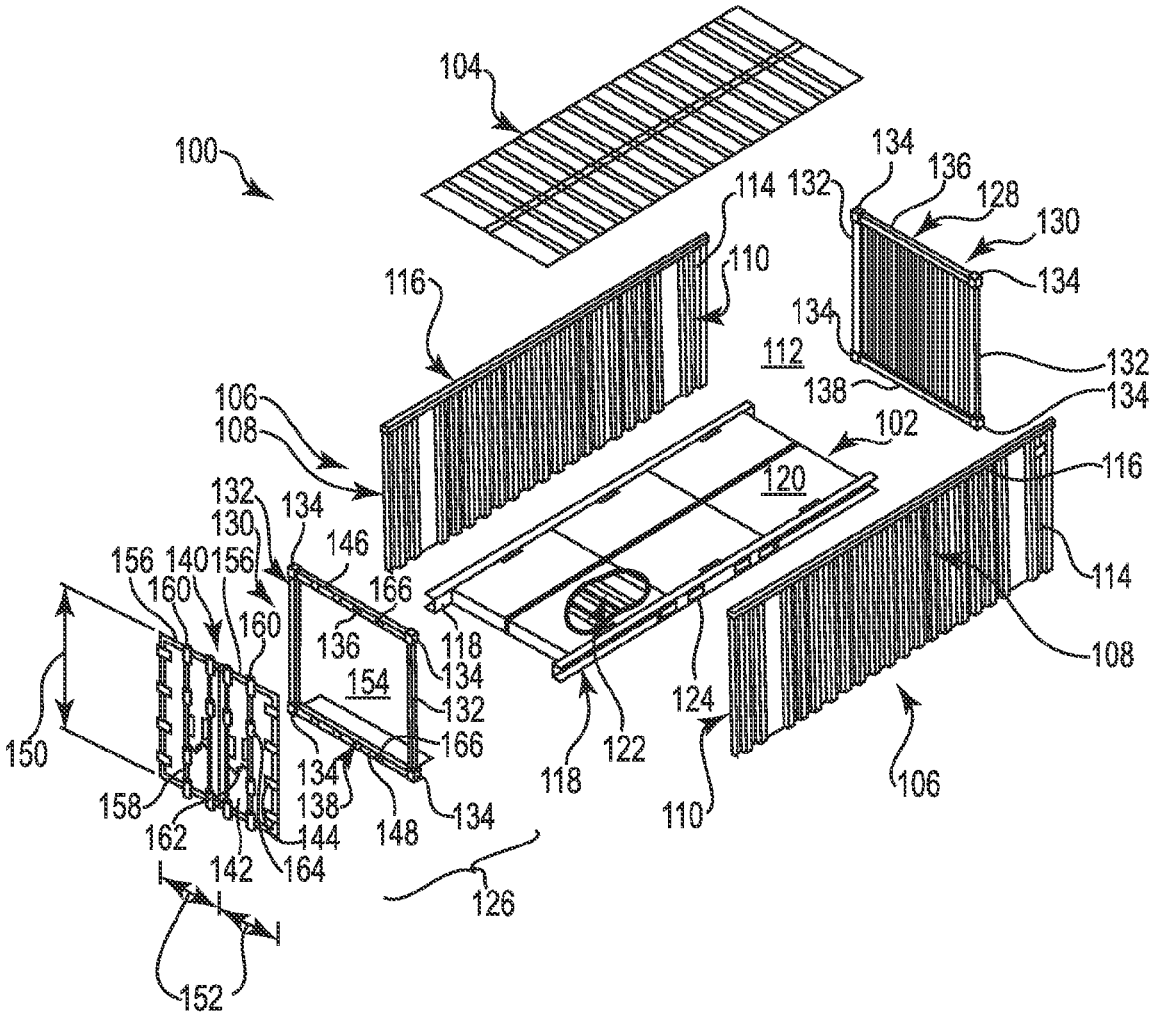
FIG. 1 provides an exploded view of a freight container according to the present disclosure.

Freight containers (also known as containers, shipping containers, intermodal containers and/or ISO containers, among other names) can be transported by rail, air, road and/or water. Freight containers are often times transported empty. Because the freight container occupies the same volume whether it contains goods or not, the cost (both financial and environmental) to transport an empty freight container can be equivalent to the cost of transporting a full freight container. For example, the same number of trucks (e.g., five) would be needed to transport the same number of empty freight containers (e.g., five). In addition, freight containers often times sit empty at storage facilities and/or transportation hubs. Regardless of where the freight container is located (in transit or in storage) the volume an empty freight container occupies is not being used to its full potential.

One solution to these issues would be a reversibly foldable freight container, as is discussed herein. Having a reversibly foldable freight container would allow for an "empty" freight container to be folded to achieve a volume that is smaller than its fully expanded state. This extra volume acquired by at least partially folding the freight container could then be used to accommodate other at least partially folded freight containers, provide additional volume for non-foldable (e.g., regular) freight containers and/or foldable freight containers in their fully expanded state. So, for example, a number of reversibly foldable freight containers that are empty (e.g., five) could be folded and nested in such a way that one truck could transport the number of empty freight containers. As a result the environmental and cost savings are expected to be significant.

As used herein, "a," "an," "the," "at least one," and "one or more" are used interchangeably. The term "and/or" means one, one or more, or all of the listed items. The recitations of numerical ranges by endpoints include all numbers subsumed within that range (e.g., 1 to 5 includes 1, 1.5, 2, 2.75, 3, 3.80, 4, 5, etc.).

The figures herein follow a numbering convention in which the first digit or digits correspond to the drawing figure number and the remaining digits identify an element in the drawing. Similar elements between different figures may be identified by the use of similar digits. For example, 366 may reference element "66" in FIG. 3, and a similar element may be referenced as 466 in FIG. 4. It is emphasized that the purpose of the figures is to illustrate and the figures are not intended to be limiting in any way. The figures herein may not be to scale and relationships of elements in the figures may be exaggerated. The figures are employed to illustrate conceptual structures and methods herein described.

FIG. 1 illustrates an exploded view of a freight container 100 according to one or more embodiments of the present disclosure. The freight container 100 includes a floor structure 102, a roof structure 104 opposite the floor structure 102, and a sidewall structure 106 that joins the floor structure 102 and the roof structure 104. Each of the sidewall structures 106 has an exterior surface 108 and an interior surface 110, where the interior surface 110 of the sidewall structures 106, the floor structure 102 and the roof structure 104 at least partially defines a volume 112 of the freight container 100.

The sidewall structure 106 includes a sidewall panel 114 that is joined to a upper side rail 116 and a bottom side rail 118. The floor structure 102 includes flooring 120 that is attached to cross members 122 (in FIG. 1 a portion of the flooring 120 has been removed to show the cross members 122), where the cross members 122 are joined to the bottom side rail 118. The bottom side rail 118 can further include forklift pockets 124.

The freight container 100 further includes a rear wall 126 and a front wall 128. Each of the rear wall 126 and the front wall 128 include an end frame 130 joined with the roof structure 104, the floor structure 102 and the sidewall structures 106. The end frame 130 includes corner posts 132, corner fittings 134, a header 136 and a sill 138.

The rear wall 126 includes a door assembly 140. The door assembly 140 can include a door 142 attached to the end frame 130 of the rear wall 126 with hinges 144. The end frame 130 of the rear wall 126 includes the header 136, which is also referred to as a door header 146 for the door assembly 140, and the sill 138, which is also referred to as a door sill 148 for the door assembly 140. The corner posts 132 extend between and couple the door sill 148 and the door header 146.

FIG. 1 provides an embodiment of the door assembly 140 that includes two of the doors 142, where each door 142 is attached by the hinges 144 to corner posts 132. Each door 142 has a height 150 and a width 152 that allows the door 142 to fit within an area 154 defined by the end frame 130 of the rear wall 126. The door 142 can further include a gasket 156 around a perimeter of the door 142 to help provide weatherproofing on the exterior portion of the rear wall 126.

The door 142 includes a locking rod 158 having a cam 160 and a handle 162. The locking rod 158 can be mounted to the door 142 with a bearing bracket assembly 164, where the locking rod 158 turns within and is guided by the bearing bracket assembly 164 to engage and disengage the cam 160 and a cam keeper 166. The cam keeper 166 is mounted on the end frame 130, specifically the cam keeper 166 is mounted on the door header 146 and the door sill 148 of the end frame 130 of the rear wall 126.

The locking rod 158 mounted to the door 142 can move between a first predetermined position where the cam 160 is aligned with and can engage the cam keeper 166, as discussed above, and a second predetermined position. In the second predetermined position the cam 160 is disengaged from the cam keeper 166 and has a position relative the end frame 130 that allows the cam 160 and the door 142 to travel through the area 154, past the end frame 130 and the cam keeper 166 of the rear wall 126, and into the volume 112 of the freight container 100. In other words, in the second predetermined position portions of the locking rod 158 have been moved, as described herein, so as to position the cam 160 directly adjacent the surface of the door 142 so that the door 142 can be opened into the volume 112 of the freight container 100. As discussed herein, opening the door 142 into the volume 112 of the freight container 100 is accomplished, in addition to having the locking rod 158 in the second predetermined position, with the use of the hinge 144 of the present disclosure, as will be more fully discussed herein.

Figure 2:
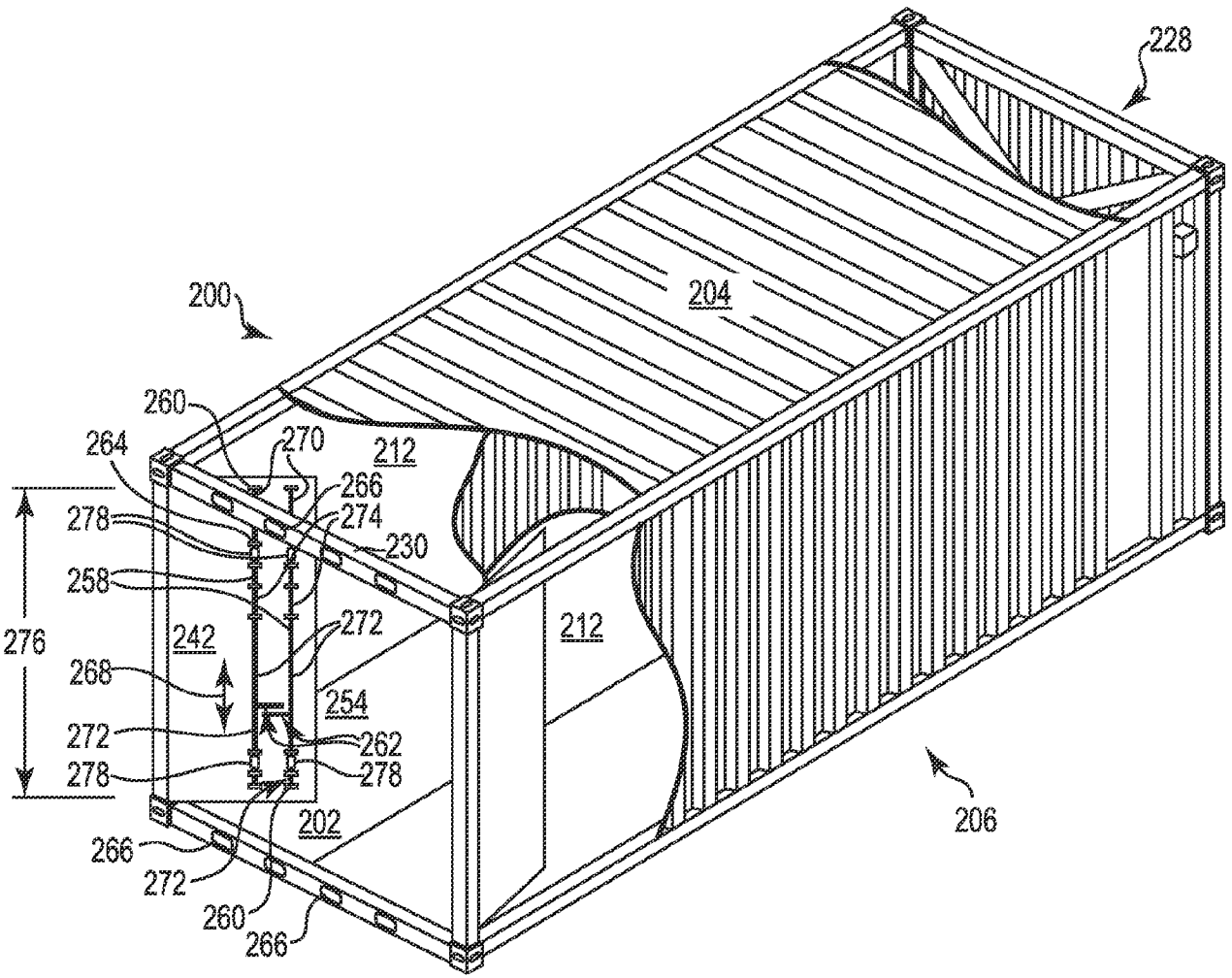
FIG. 2 provides a perspective view of a freight container according to the present disclosure.

For the various embodiments, the first predetermined position is shown in FIG. 1, where the cam 160 and the cam keeper 166 are positioned relative each other so the cam 160 can engage and disengage the cam keeper 166 positioned on the end frame 130. FIG. 2 provides an illustration of the cam 260 in at least one embodiment of the second predetermined position relative the cam keeper 266. As illustrated in FIG. 2, the cam 260 has been positioned, relative the first predetermined position, so that the cam 260 is no longer aligned so as to engage and/or disengage the cam keeper 266. The cam 260 is also positioned relative the end frame 230 such that the cam 260 can pass through the area 254 defined by the end frame 230 as the door 242 travels into the volume 212 of the freight container 200, where the volume 212 can be defined, at least in part, by the floor structure 202, the roof structure 204, the sidewall structure 206 and the rear wall 228 (shown with cutaways to help better illustrate the position of the doors 242 in the volume 212 defined by the freight container 200).

For the various embodiments, moving the cam 260 between the first predetermined position and the second predetermined position can be accomplished in a number of different ways. For example, the locking rod 258 can have two or more portions that can telescope along a longitudinal axis 268 of the locking rod 258. The locking rod 258 can include a first portion 270 and a second portion 272 joined to the first portion 270 with a connection shaft 274. The first portion 270 and the second portion 272 can telescope relative the connection shaft 274 to change a length 276 of the locking rod 258.

For example, the first portion 270 and the second portion 272 can travel along the connection shaft 274 between the first predetermined position and the second predetermined position. As illustrated, the connection shaft 274 can be held in place on the door 242 with a combination of the bearing bracket assembly 264 and an anti-rack ring 278. For the various embodiments, the anti-rack ring 278 can be joined to the connection shaft 274 on either end of the bearing bracket assembly 264 such that the shaft 274 can rotate in the bearing bracket assembly 264 by turning handle 262, but will not pass vertically, relative the floor structure 202 and/or the roof structure 204, through the bearing bracket assembly 264 (e.g., the connection shaft 274 will not move up and/or down relative the bearing bracket assembly 264) due to the presences of the anti-rack ring 278.

Figure 3A:
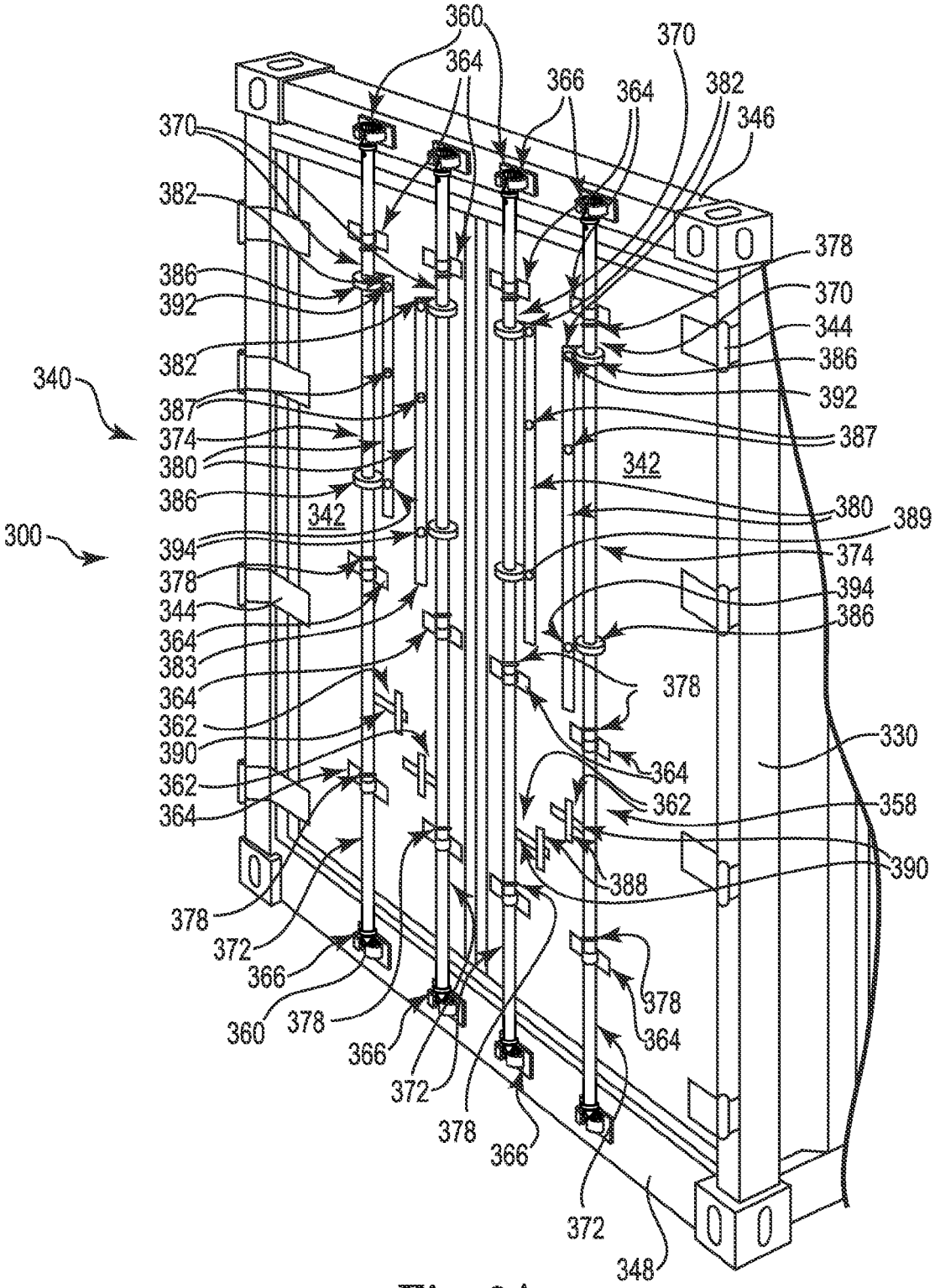
FIGS. 3A and 3B provide a perspective view of a door assembly with locking rods in the first predetermined position with cams of the locking rods engaged with the cam keepers (FIG. 3A) and the second predetermined position with cams of the locking rods disengaged with the cam keepers (FIG. 3B) according to the present disclosure.
Figure 3B:
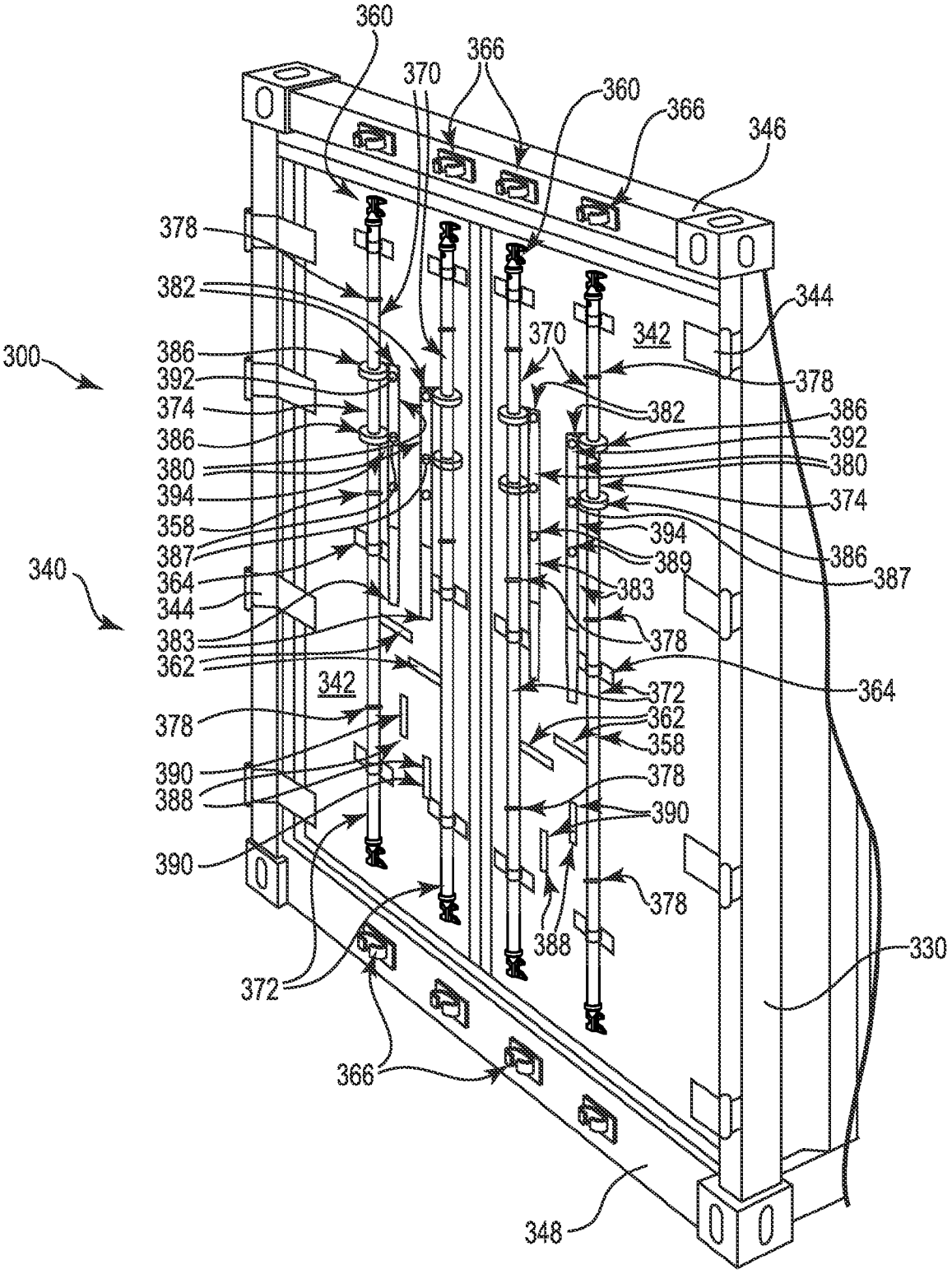

Referring now to FIGS. 3A and 3B there is shown the door assembly 340 with the locking rods 358 in the first predetermined position (e.g., the cam 360 aligned with and can engage the cam keeper 366 as illustrated in FIG. 3A) and the second predetermined position (e.g., the cam 360 disengaged from the cam keeper 366 and has a position relative the end frame 330 that allows the cam 360 and the door 342 to travel into the volume of the freight container 300 as illustrated in FIG. 3B). As illustrated, the door assembly 340 includes doors 342, hinges 344, door header 346, door sill 348, locking rod 358, cam 360, handle 362, bearing bracket assembly 364 and cam keeper 366, as discussed herein. The embodiments illustrated in FIGS. 3A and 3B also include each of the first portion 370 and the second portion 372, where each of the portions 370 and 372 include a socket 386 for receiving at least a portion of the connection shaft 374. For the various embodiments, it is along and through the socket 386 that each of the first portion 370 and the second portion 372 can travel relative the connection shaft 374 as the locking rod 358 telescopes to change the length of the locking rod 358 between the first predetermined position as illustrated in FIG. 3A and the second predetermined position as illustrated in FIG. 3B.

For the various embodiments, the socket 386 and the connection shaft 374 can have a cross-sectional shape that does not allow the connection shaft 374, the first portion 370 and/or the second portion 372 to rotate relative to each other to any significant degree. Such cross-sectional shapes can include, but are not limited to, non-circular cross sectional shapes such as oval, elliptical, or polygonal, such as triangular, square, rectangular, or higher polynomial such as pentagonal, hexagonal, etc. For the various embodiments, the connection shaft 374 can further include a bearing bracket assembly, as discussed herein, in which to rotate and to provide support for the connection shaft 374 in its position relative the first and second portions 370 and 372. For the various embodiments, it is possible that the socket 386 may also include a bushing positioned between the connection shaft 374 and each of the first and second portions 370 and 372. For the various embodiments, the bushing can be made of a polymer, such as polytetrafluoroethylene.

For the various embodiments, the first portion 370 and the second portion 372 can be mounted to the door 342 with a combination of the bearing bracket assembly 364 and the anti-rack ring 378. For example, each of the first portion 370 and the second portion 372 can have bearing bracket assembly 364 and anti-racking ring 378 joined to each portion 370 and 372 that allows the portions 370 and 372 to rotate in the bearing bracket assembly 364 by turning the handle 362. For the various embodiments, the second portion 372 can include the handle 362. For the various embodiments, the door 342 further includes a retainer plate 388 and a retainer catch 390 to receive and releasably hold the handle 362 against the door 342.

As illustrated, the anti-racking ring 378 on each of the first portion 370 and the second portion 372 of the locking rod 358 is positioned between the bearing bracket assembly 364 for the connection shaft 374 and the bearing bracket assembly 364 for the respective portion 370 and 372. This configuration allows each of the first portion 370 and/or the second portion 372 to telescope, relative the floor structure and roof structure, between the first predetermined position (FIG. 3A) and the second predetermined position (FIG. 3B), discussed herein. For the various embodiments, the anti-racking rings 378 can also act as stops that limit the degree of travel of the first and second portions 370 and 372 of the locking rod 358.

The locking rod 358 can also include an adjustment member 380 that can releasably join the first portion 370 and the second portion 372 of the locking rod 358. For the various embodiments, the adjustment member 380 includes a first end 382 and a second end 383, with surfaces defining a first opening 387 adjacent the first end 382 and a second opening 389 between the first opening 387 and the second end 283 of the adjustment member 380. For the various embodiments, the adjustment member 380 can be non-releasably, but pivotally, attached to the first portion 370 at or adjacent the first end 382. For the various embodiments, the first and second openings 387 and 389 can then be used to releasably couple the first and second portions 370 and 372 of the locking rod 358 in either one of the first predetermined position (seen in FIG. 3A) and/or the second predetermined position (seen in FIG. 3B).

The adjustment member 380 can be a forged metal bar that is non-releasably, but pivotally, attached by a hub mount bracket 392 to the first portion 370. The adjustment member 380 can also be a cast or machined metal bar that is non-releasably, but pivotally, attached by a hub mount bracket 392 to the first portion 370. A rivet can be used to couple the adjustment member 380 to the hub mount bracket 392. The second portion 372 can also include a mounting bracket 394 that can receive and releasably couple the adjustment member 380. The mounting bracket 394 can include a pin or a shaft over which either one of the first opening 387 or the second opening 389 on the adjustment member 380 can be positioned. For the various embodiments, the pin or shaft on the mounting bracket 394 can have a surface that defines an opening through the pin or shaft. The opening through the pin or shaft can be located such that when either one of the first opening 387 or the second opening 389 is positioned over the pin or shaft the opening can releasably receive an R-pin or R-clip. Once in position, the R-pin or R-clip can hold the adjustment member 380 so as to keep the locking rod 358 rigid (e.g., rigid along the longitudinal axis of the locking rod 358). The locking rod 358 in its first predetermined position can perform an anti-racking function, as is known in the art. As appreciated, other structures besides R-pins or R-clips can be used to releasably secure the adjustment member 380 between the first portion 370 and the second portion 372.

The adjustment member 380 can also be used to telescope (e.g., move) the first portion 370 of the locking rod 358 between the first predetermined position and the second predetermined position. Similarly, the handle 362 can be used to telescope (e.g., move) the second portion 372 of the locking rod 358 between the first predetermined position and the second predetermined position.

Figure 4:
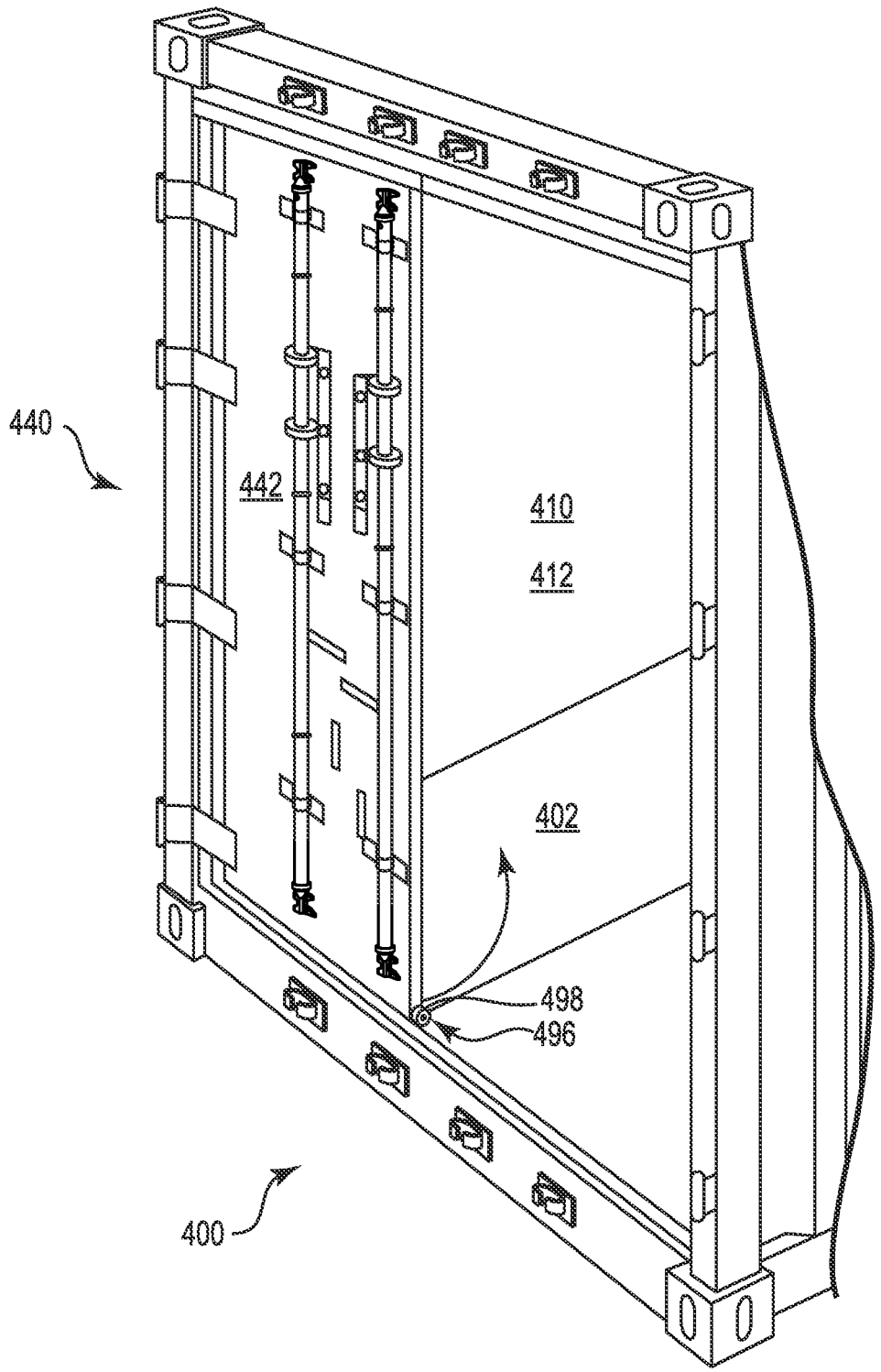
FIG. 4 provides a perspective view of the door assembly according to the present disclosure.

Referring now to FIG. 4, there is shown an embodiment of the door assembly 440 of the present disclosure. As illustrated, only one door 442 is shown so as to better illustrate the following embodiment. The door assembly 440 includes the components as discussed herein for FIGS. 1 through 3B. For the various embodiments, the door 442 illustrated in FIG. 4 further includes a wheel 496 positioned between the door 442 and the floor structure 402. For the various embodiments, more than one wheel 496 can be used with the door 442 (e.g., two of wheel 496, three of wheel 496, etc. could be used with the door 442).

The wheel 496 can help to support the weight of and guide the door 442 as it travels into the volume 412 of the freight container 400. The wheel 496 includes an axle 498 on which the wheel 496 rotates. The axle 498 can be fixed to the wheel 496 where the axle 498 is supported by and rotates on a bracket housed within the door 442 structure. Alternatively, the axle 498 can be fixed to the door 442, where the wheel 496 includes a bearing or bushing that allows the wheel 496 to rotate around the axle 498.

Figure 5:
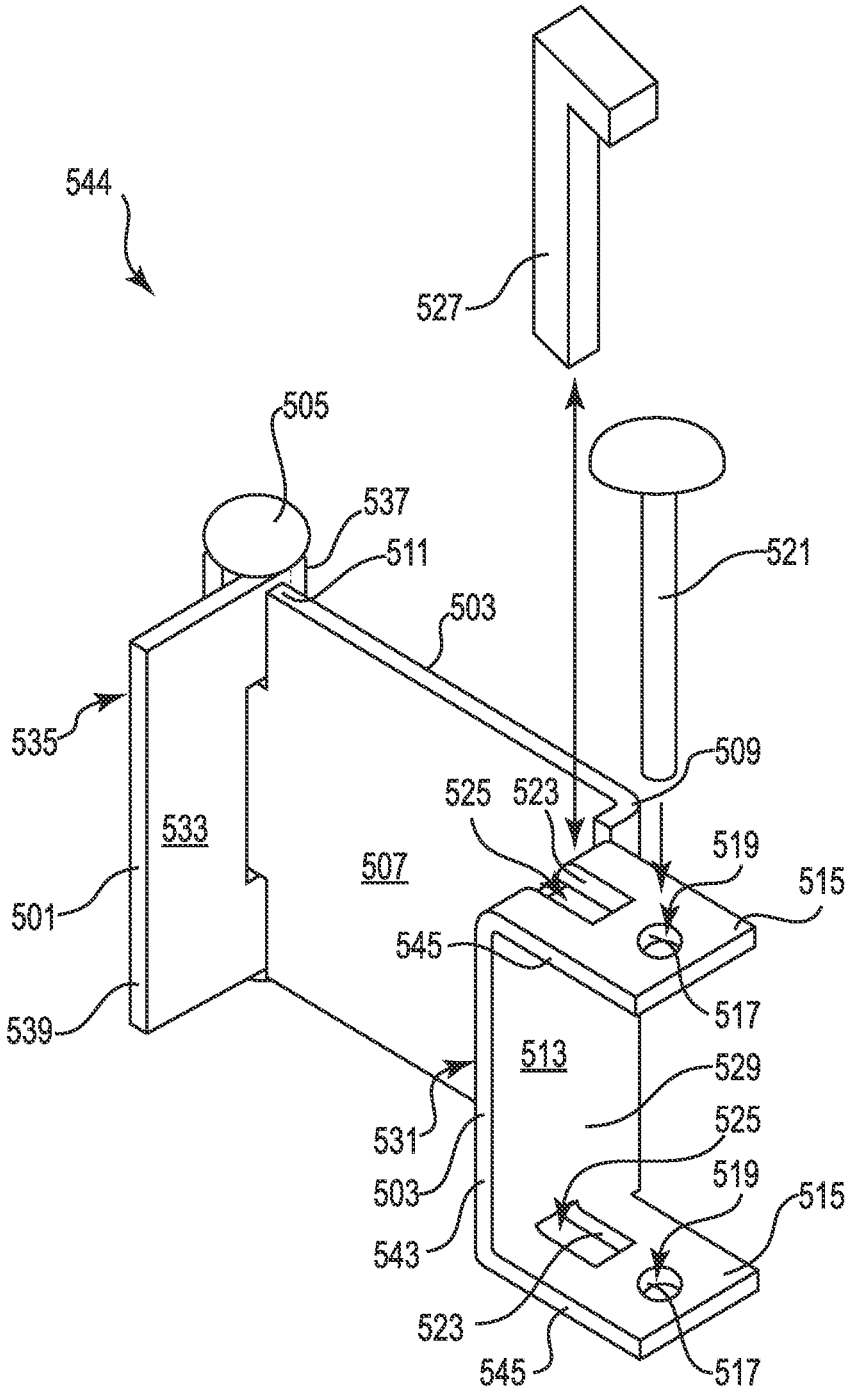
FIG. 5 provides a perspective view of a hinge according to the present disclosure.

Referring now to FIG. 5, there is shown an embodiment of the hinge 544 according to the various embodiments of the present disclosure. As illustrated, the hinge 544 includes a first wing 501 and a second wing 503, where the first wing 501 and the second wing 503 are pivotally connected by a first hinge pin 505. For the various embodiments, the second wing 503 includes a first planar portion 507 with a first end 509 and a second end 511 and a second planar portion 513 that extends perpendicular from the first end 509 of the first planar portion 507. The first hinge pin 505 pivotally connects the first wing 501 to the second end 511 of the first planar portion 507. As illustrated, a portion of the first planar portion 507 of the second wing 503 passes through an opening defined in the first wing 501 so as to allow the second end 511 of the first planar portion 507 of the second wing 503 to pivotally connect to the first hinge pin 505 and the first wing 501.

The hinge 544 also includes a pair of hinge lugs 515 that extend from the second planar portion 513 of the second wing 503. Each of the hinge lugs 515 has a first set of surfaces 517 defining openings 519 through which a second hinge pin 521 passes. For the various embodiments, at least one of the pair of hinge lugs 515 has a surface 523 defining an opening 525 through which a locking pin 527 travels. The locking pin 527 can reversibly travel through the opening 525, where in a first position with the locking pin 527 positioned completely outside the opening 525 the second wing 503 is unlocked relative the first wing 501, and when the locking pin 527 is at least partially, or completely, positioned through the opening 525 the second wing 503 is locked relative the first wing 501.

The second planar portion 513 of the second wing 503 includes a first major surface 529 and a second major surface 531 opposite the first major surface 529. The pair of hinge lugs 515 extends from the first major surface 529 of the second planar portion 513. The first wing 501 has a first major surface 533 and a second major surface 535 opposite the first major surface 533. In a first predetermined position the first wing 501 is perpendicular to the first planar portion 507 of the second wing 503 and the first major surface 533 of the first wing 501 is directly opposite and parallel with the second major surface 531 of the second planar portion 513. As will be discussed more fully herein, the first predetermined position can occur with the first wing 501 attached to a corner post of the freight container and the second wing 503 of the hinge 544 is positioned against (e.g., adjacent to and in at least partial contact with) the corner post.

The first wing 501 has a first end 537 and a second end 539, and where the first hinge pin 505 pivotally connects the first end 537 of the first wing 501 to the second end 511 of the first planar portion 507 of the second wing 503. The second planar portion 513 has an end 543 that is distal to the first end 509 of the first planar portion 507 and the pair of hinge lugs 515 extending from the second planar portion 513 have a first peripheral edge 545, where the end 543 of the second planar portion 513 and the first peripheral edge 545 of the hinge lugs 515 lay in a common plane.

Figure 6:
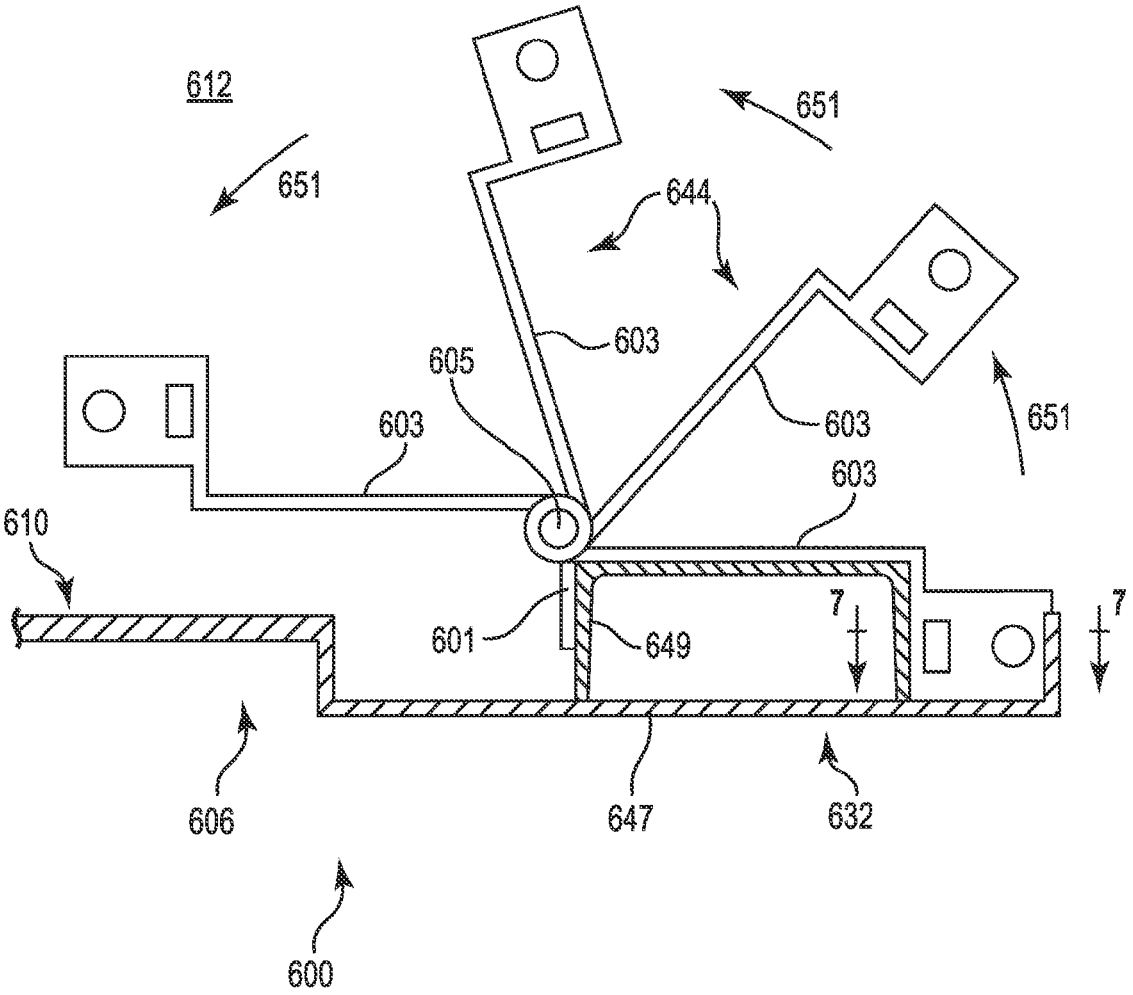
FIG. 6 provides a planar view of the hinge fastened to a corner post of a freight container according to the present disclosure.

Referring now to FIG. 6, there is shown a top down view of the hinge 644 according to the present disclosure that has been mounted on a corner post 632 of a freight container 600. For the various embodiments, only a portion of the freight container 600 is illustrated in FIG. 6 to allow for a better view and understanding of the operation of the hinge 644. For the various embodiments, the corner post 632 of the freight container 600 is formed from a "J" bar 647 and a "U"-channel 649, where the J-bar 647 and the U-channel 649 are welded together to form the corner post 632 of the freight container 600. A "U"-channel 649 is also known as an "inner post."

As illustrated, the first wing 601 is fastened to a portion of the U channel 649. The first wing 601 can be fastened to the portion of the U channel by a welding (e.g., arc-welding) process. The second wing 603 (illustrated in multiple positions in FIG. 6 as the second wing 603 pivots about the first hinge pin 605) is free to pivot around the first hinge pin 605. The travel path 651 of the second wing 603 shown in FIG. 6 is into the volume 612 of the freight container 600 (as partially defined by the interior surface 610 of the side wall structure 606 of the freight container 600).

Figure 7:
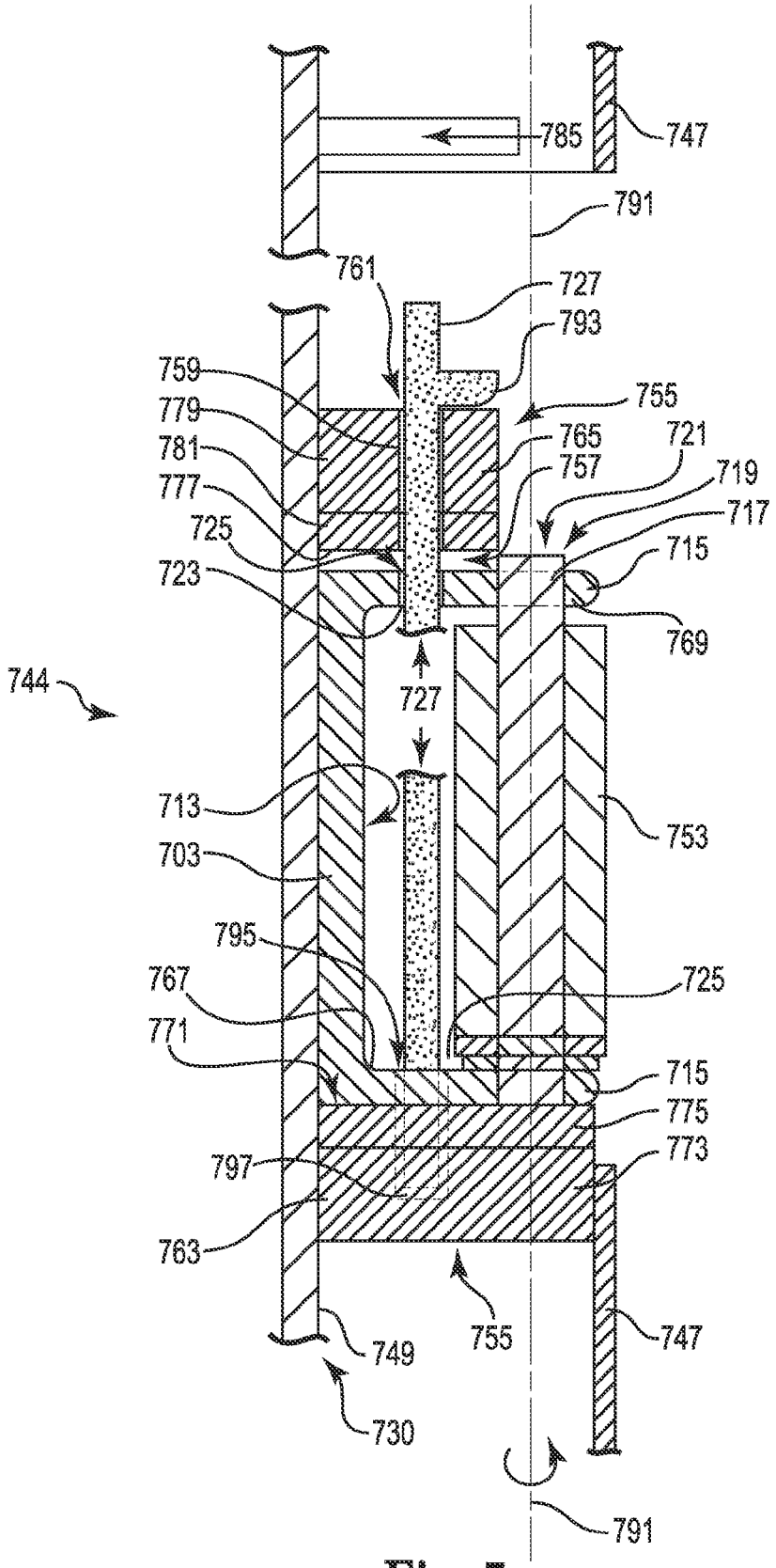
FIG. 7 provides a planar view of the hinge fastened to a corner post of a freight container according to the present disclosure.

Referring now to FIG. 7, there is shown the hinge 744 in the first predetermined position (as illustrated in FIG. 5) on the freight container 700 as viewed along lines 7-7 in FIG. 6. The embodiment illustrated in FIG. 7 also includes the locking pin 727 and the second hinge pin 721 as illustrated in FIG. 5. As illustrated, the second wing 703 includes hinge lugs 715 that extend from the second planar portion 713, and which hinge lugs 715 include the first set of surfaces 717 defining openings 719 through which the second hinge pin 721 passes and is seated. As will be discussed more fully herein, the door of the fright container pivots (e.g., swings) about second hinge pin 721. The hinge lugs 715 also include the surface 723 defining the opening 725 through which the locking pin 727 travels.

FIG. 7 also shows the hinge 744 having a pair of seating blocks 755 fastened to the end frame 730 (only a portion of which is shown) of the container to form a socket 757 that receives and seats the second planar portion 713 and at least a portion of the pair of hinge lugs 715. As illustrated, the U-channel 749 of end frame 730 helps to form a portion of the socket 757. A portion of the J-bar 747 is removed so as to create a volume into which the second wing 703 can reside and so as to allow the hinge 744 to pivot such that door can swing towards the exterior surface of the sidewall structure (a feature that is more fully illustrated and discussed herein). At least one of the pair of seating blocks 755 has a surface 759 defining an opening 761 through which the locking pin 727 travels to lock and un-lock the second wing 703 from the corner post of the freight container. As discussed herein, the locking pin 727 reversibly travels to lock and un-lock the second wing 703 from the corner post of the freight container.

The door is joined to the pair of hinge lugs 715, as illustrated herein, with the second hinge pin 721 where the door pivots on the second hinge pin 721 relative the pair of hinge lugs 715 when the hinge lugs 715 are locked to the corner post of the freight container. This allows the door to extend adjacent the exterior surface of the sidewall structure. In addition, the door and the second wing 703 can pivot on the first hinge pin when the hinge lugs 715 are un-locked to the corner post of the freight container to allow the door to travel into the volume of the freight container and extend adjacent the interior surface of the sidewall structure. These embodiments will be illustrated and further discussed herein.

The pair of seating blocks 755 can include a lower seating block 763 and an upper seating block 765. The pair of hinge lugs 715 includes a lower hinge lug 767 and an upper hinge lug 769. The lower hinge lug 767 can releasably seat, or rest, on the lower seating block 763. The upper seating block 765 can have the surface 759 defining the opening 761 through which the locking pin 727 travels through the opening 725 of the hinge lug 769 to lock and un-lock the second wing 703 from the corner post of the freight container. The lower hinge lug 767 can also include a surface 795 defining an opening 797 through which the locking pin 727 travels. Each of the lower seating block 763 and the upper seating block 765 also include a surface defining an opening through which the locking pin 727 travels to lock and un-lock the second wing 703 from the corner post of the freight container (for this embodiment, the locking pin 727 would be of sufficient length to travel through the opening 723 of the hinge lug 769 and the opening 797 in the lower hinge lug 767 and the lower seating block 763 to lock and un-lock the second wing 703 from the corner post of the freight container).

As illustrated in FIG. 7, the lower seating block 763 can include a first surface 771, on which the lower hinge lug 767 seats or rests, a second surface 773 substantially perpendicular to the first surface 771, and a third surface 775 that slopes between the first surface 771 and the second surface 773 of the lower seating block 763. The lower hinge lug 767 travels along the third surface 775 as the second wing 703 pivots around the first hinge pin relative the first wing. The upper seating block 765 includes a first surface 777, a second surface 779 substantially perpendicular to the first surface 777, and a third surface 781 that slopes between the first surface 777 and the second surface 779, where the upper hinge lug 769 can travels along the third surface 781 as the second wing 703 pivots around the first hinge pin relative the first wing.

For the various embodiments, the end frame can also include a locking pin travel stop 785 to limit a travel distance of the locking pin 727. For the various embodiments, the locking pin 727 can also include a surface 793 defining a structure on which, or into which, a tool can be used to cause the locking pin to travel. For example, the structure can be a notch or a recess formed in the locking pin 727 that can accommodate a pry bar or other prying tool that would help in moving the locking pin 727. The locking pin 727 can secure the hinge 744 perpendicular to an axis 791 of rotation of the second hinge pin 721.

Figure 8:
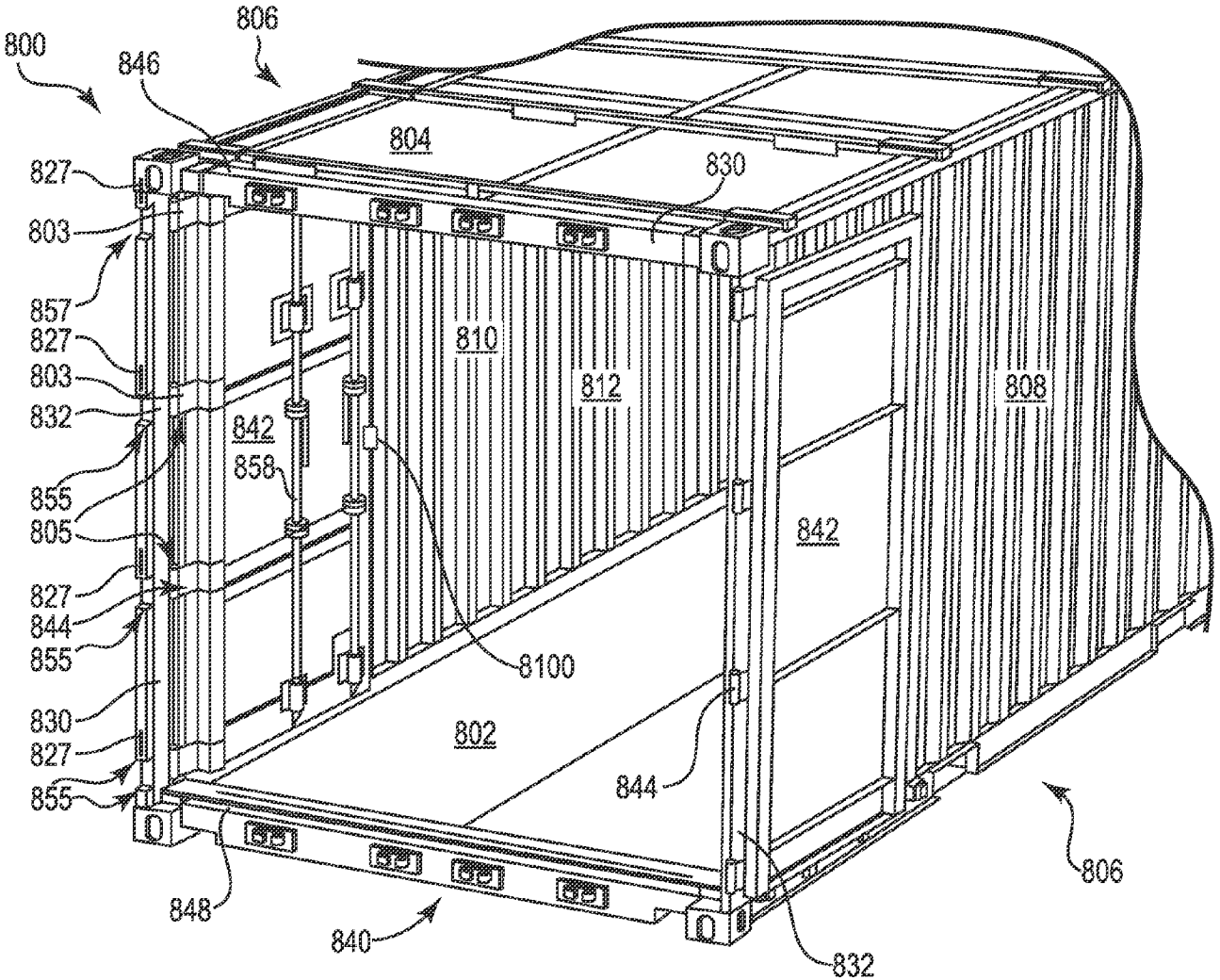
FIG. 8 provides a perspective view of a freight container according to the present disclosure.

Referring now to FIG. 8, there is shown an embodiment of the freight container 800 of the present disclosure where one of the door 842 is positioned within the volume 812 of the freight container 800, and the other of the door 842 is positioned along the exterior surface 808 of the sidewall structures 806. As illustrated, the freight container 800 includes the roof structure 804, the floor structure 802 opposite the roof structure 804, and the sidewall structures 806 between the floor structure 802 and the roof structure 804, as discussed herein. Each of the sidewall structures 806 have the exterior surface 808 and the interior surface 810, where the interior surface 810 at least partially defines the volume 812 of the freight container 800.

The freight container 800 includes the end frame 830 joined with the roof structure 804, the floor structure 802 and the sidewall structures 806, where the end frame 830 has the door sill 848, the door header 846 and corner posts 832 between the door sill 848 and the door header 846. The door assembly 840 also includes the hinge 844 on each of the corner posts 832, where the hinge is as discussed herein. The first wing of the hinge 844 is fastened to the corner post 832. The first hinge pin 805 pivotally connects the first wing fastened to the corner post 832 to the second end of the first planar portion of the second wing 803, as discussed herein.

The locking pin 827 can travel through the at least one of the pair of hinge lugs having the surface defining the opening(s) through which the locking pin travels. The freight container 800 further includes the pair of seating blocks 855, as discussed herein, fastened to the end frame 830 to form the socket 857 that receives and seats the hinge lugs of the hinge 844. As discussed herein, once the hinge 844 is seated on the seating blocks 855 in the socket 857 the locking pin 827 can travel (e.g., be moved up and/or down) to lock and un-lock the second wing of the hinge 844 from the corner post 832 of the freight container 800.

The freight container 800 further includes door 842 that is joined to the pair of hinge lugs of the hinge 844 with the second hinge pin. The door 842 pivots on the second hinge pin relative the pair of hinge lugs when the hinge lugs are locked to the corner post 832 of the freight container 800 to allow the door 842 to extend adjacent the exterior surface 808 of the sidewall structure 806. The door 842 and the second wing of the hinge 844 can also pivot on the first hinge pin when the hinge lugs are un-locked to the corner post 832 of the freight container 800 to allow the door 842 to travel into the volume 812 of the freight container 800 and extend adjacent the interior surface 810 of the sidewall structure 806. Both of these embodiments are illustrated in FIG. 8.

The sidewall structure 806 of the freight container 800 can further include a latch 8100, where the latch 8100 can be used to engage and releasable hold the door 842 adjacent the interior surface 810 of the sidewall structure 806. The door 842 is also shown with the locking rod 858, as discussed herein, mounted to the door 842. As illustrated in FIG. 8, the locking rod 858 is shown in the first predetermined position on the door 842 positioned along the exterior surface 808 of the sidewall structures 806 and the second predetermined position on the door 842 positioned within the volume 812 of the freight container 800.

Freight containers can be exposed to a variety of forces when on a ship and/or vehicle. For example, on a ship they can be exposed to movement in six degrees of freedom: rolling, pitching, heaving, swaying, surging and yawing. These motions can impart transverse racking forces on the freight container, especially when they are in a stacked configuration (e.g., fully loaded freight containers stacked ten high). These transverse racking forces can act to distort the walls and the end frames of the container.

Figure 9A:
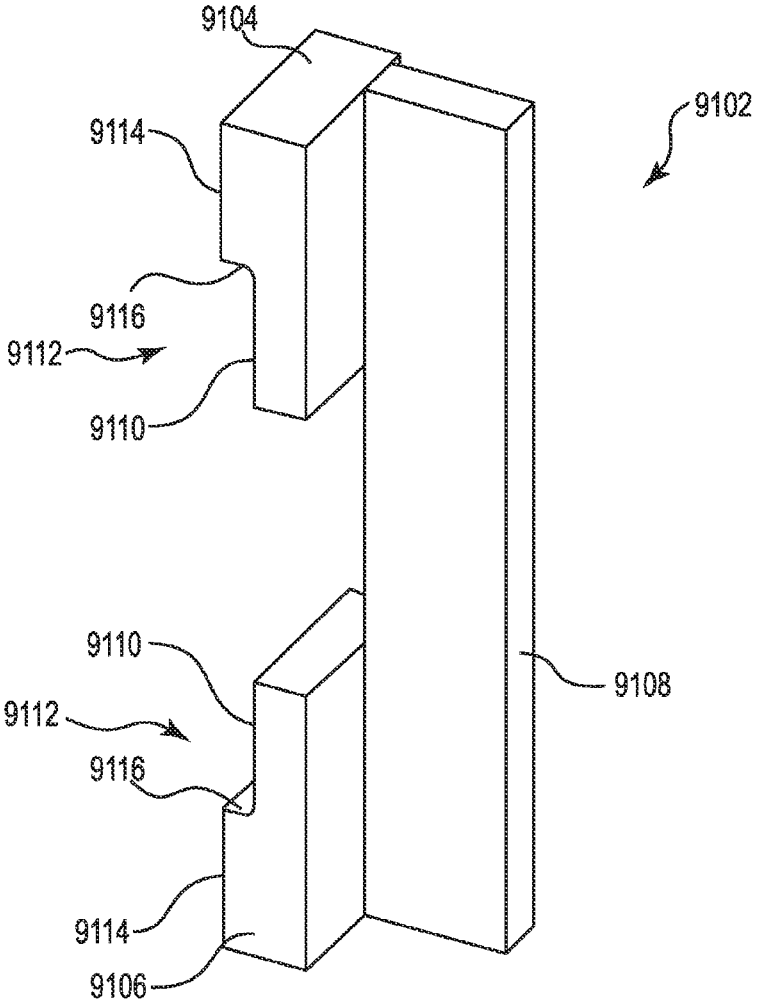
FIGS. 9A-9B provide a perspective view of an anti-racking support according to the present disclosure.
Figure 9B:
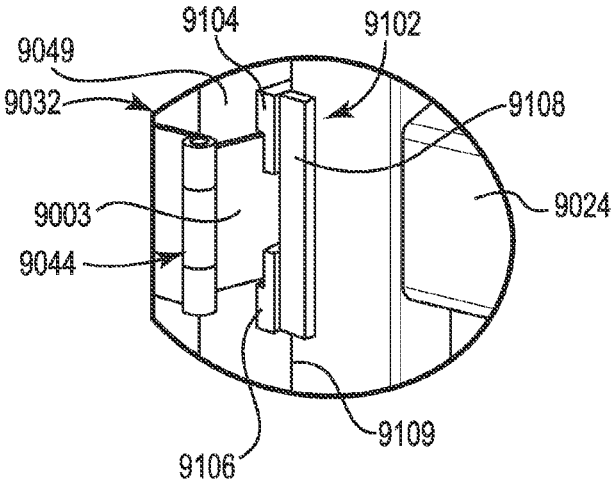
Figure 10A:
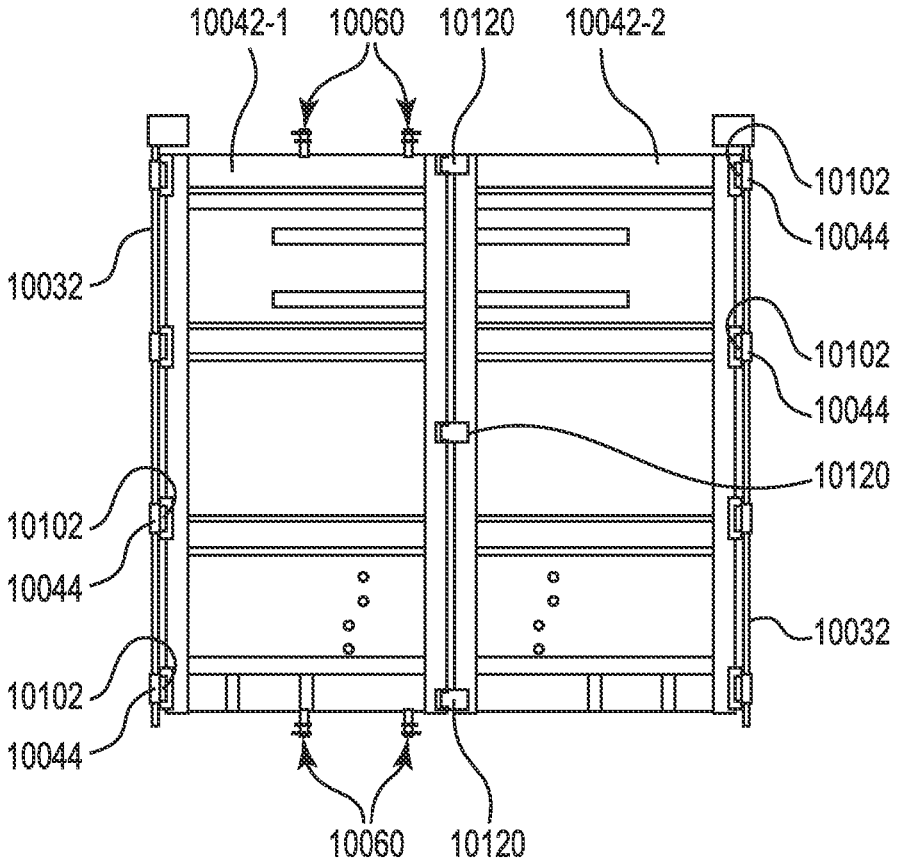
FIGS. 10A-10B provide a perspective view of an anti-racking block for the doors of a freight container according to the present disclosure.

Referring now to FIGS. 9A and 9B, there is shown an anti-racking support 9102 that can be used with the doors 9024 of the freight container (to be illustrated more fully herein). The anti-racking support 9102 includes a first lug 9104 and a second lug 9106, both of which extend from a mounting support 9108 in a common direction. The mounting support 9108 can have an elongate configuration with a square or rectangular cross-sectional shape (as seen). The mounting support 9108 can be welded and/or fastened (e.g., bolted or screwed) to the door 9024 (e.g., an inside surface as illustrated in FIG. 10A) of the freight container to mount the anti-racking support 9102 in such a way that the first lug 9104 and the second lug 9106 of the anti-racking support 9102 extend from a peripheral edge 9109 of the door 9024 of the freight container.

The first lug 9104 and the second lug 9106 each have a first surface 9110 that defines a recess 9112 relative a second surface 9114. The first surfaces 9110 and the second surfaces 9114 of each of the first lug 9104 and the second lug 9106 can be parallel to each other. When mounted to the door 9024 of the freight container, the recess 9112 of the first lug 9104 and the second lug 9106 can receive and straddle at least a portion of the second wing 9003 of the hinge 9044, as provided herein, when the door is in a closed and/or locked (cams of door engaged with the cam keepers) position. The first surface 9110 of the first lug 9104 and the second lug 9106 can also be directly adjacent to (e.g., no intervening structures) and/or make physical contact with the at least a portion of the second wing 9003 of the hinge when the door is in a closed and/or locked (cams of door engaged with the cam keepers) position. Similarly, the second surface 9114 of the first lug 9104 and the second lug 9106 can also be directly adjacent to and/or make physical contact with the "U"-channel 9049 of the corner post 9032 of the freight container when the door is in a closed and/or locked (cams of door engaged with the cam keepers). As a result, the anti-racking support 9102 can be directly adjacent to and/or in contact with both the hinge 9044 and the corner post 9032 when the cam is engaged with the cam keeper.

Each of the first lug 9104 and the second lug 9106 also include a third surface 9116 that extends between the first surface 9114 and the second surface 9110. The third surface 9116 helps to define the recess 9112. The third surface 9116 also can be directly adjacent to and/or make physical contact with at least a portion of the second wing 9003 of the hinge 9044 when the door 9024 is in a closed and/or locked (cams of door engaged with the cam keepers) position.

One of the anti-racking support 9102 can be mounted to the door 9024 of the freight container relative to each hinge 9044 (e.g., one anti-racking support 9102 for each hinge 9044). When the door 9024 of the freight container is closed and locked (cams of door engaged with the cam keepers) the anti-racking support 9102 can help to impede transverse racking of the freight container. For example, the anti-racking support 9102 can make contact with the U-channel 9049 during racking so as to help the doors 9024 keep parallel to the plane of the corner posts. The anti-racking support 9102 can also help to minimize mechanical stresses on the hinge 9044 of the door 9024 of the freight container when it is closed and locked (cams of door engaged with the cam keepers). One way this is accomplished is by the anti-racking support 9102 making contact with the hinge 9044 (e.g., the second wing 9003) and pressing the hinge 9044 against the U-channel 9049 so as to keep the hinge 9044 in its same relative position under non-racking conditions.

The use of the anti-racking support 9102 on the door 9024, as discussed herein, helps to limit the impact of racking forces the freight container. When in their closed and locked configuration, the anti-racking support 9102 and the locking rods help to maintain the relative perpendicular position of the doors 9024 under racking conditions (e.g., maintain their rectangular shape against the external racking forces). When racking is occurring the anti-racking support 9102 can provide a "node" through which racking forces (e.g., lateral forces) can be transferred through the doors 9024. These racking forces can be absorbed through either the anti-racking supports 9102 on the adjacent door and/or locking rods via the cam, cam keepers and end frame of the freight container. The use of the anti-racking support 9102 in conjunction with the hinge and freight container of the present disclosure can allow a freight container, as provided herein, to meet the requirements of ISO 1496 (fifth edition 1990 Aug. 15) and its amendments.

Figure 10B:
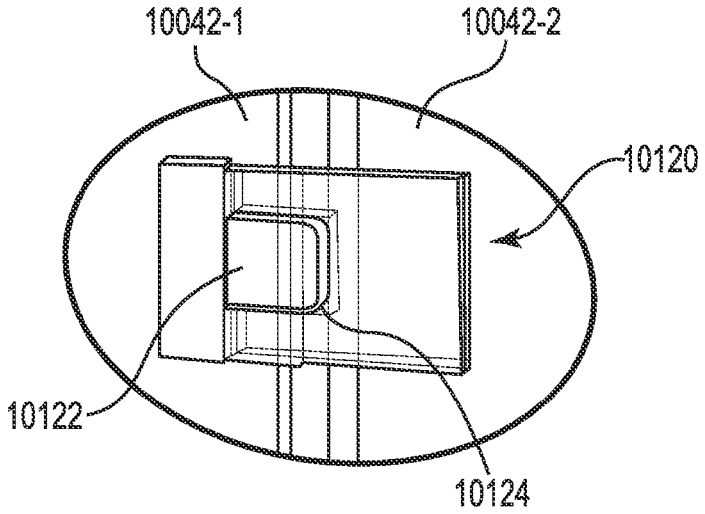

Referring now to FIGS. 10A and 10B there is shown an embodiment of a door 10042 (as viewed from the "inside" of the freight container) with the anti-racking support 10102 positioned adjacent the hinge 10044 mounted to the corner post 10032. FIGS. 10A and 10B also provide an illustration of an anti-racking block 10120 mounted to the doors 10042-1 and 10042-2. The anti-racking block 10120 includes a tab 10122 and a slot 10124 to releasably receive the tab 10122. As illustrated, the tab 10122 extends from the first of the door 10042-1 and the slot 10124 extends from the second of the door 10042-2 such that the tab 10122 can seat within the slot 10124 (e.g., completely within the slot 10124) when the cam 10060 of each of the first of the door 10042-1 and the second of the door 10042-2 are engaged with their respective cam keeper.

The anti-racking block 10120 helps to limit the impact of racking forces the freight container. The anti-racking block 10120 also helps to maintain the perpendicular symmetry of the end frame and the doors 10042 of the freight container during transverse racking. As illustrated, the anti-racking block 10120 can transfer forces in both the horizontal and vertical planes (e.g., via all three sides of the slot 10124). This helps to keep the doors 10042-1 and 10042-2 in a common plane and helps to maintain the perpendicular symmetry of the end frame and the doors 10042 of the freight container during transverse racking. This also helps to make the two doors (10042-1 and 10042-2) act as one large structure instead of two independent structures.

So, the anti-racking block 10120 used in conjunction with the anti-racking support 10102 and the locking rods helps to maintain the relative symmetrical position of the doors 10042 under racking conditions (e.g., maintain their rectangular shape against the external racking forces). For example, when racking is occurring the anti-racking support 10102 and the anti-racking block 10120 can provide the "nodes" through which racking forces (e.g., lateral forces) can be transferred through the doors 10042. These racking forces can be absorbed through either the anti-racking supports 10102 on the adjacent door and/or locking rods via the cam, cam keepers and end frame of the freight container.

Figure 11A:
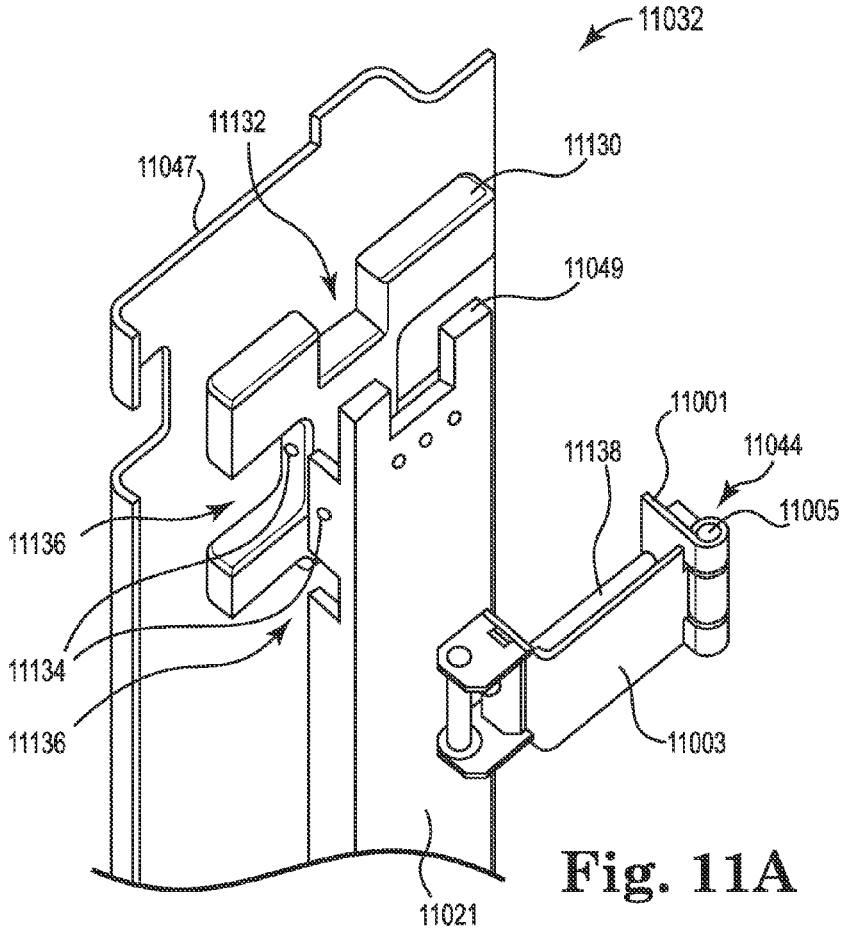
FIGS. 11A-11B provide a perspective view of a hinge for the doors of a freight container according to the present disclosure.
Figure 11B:
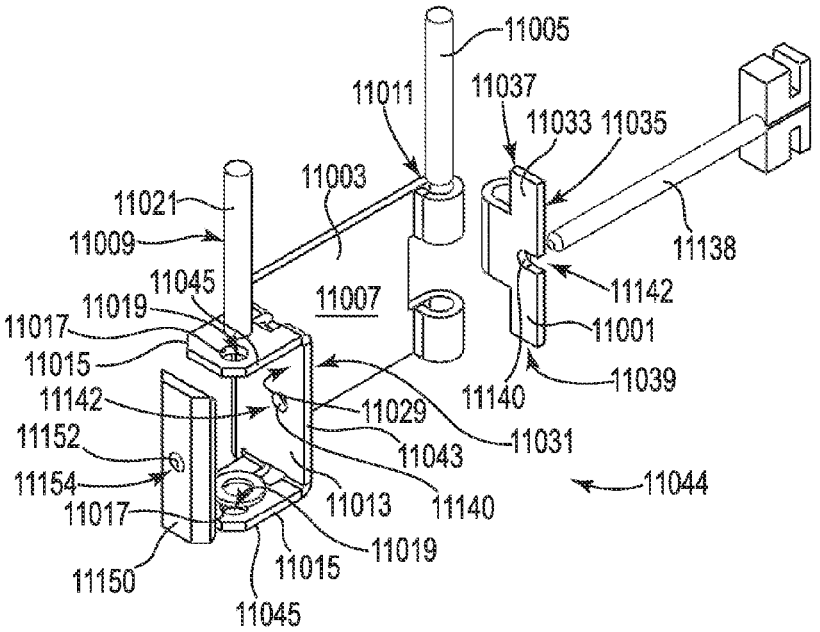

Referring now to FIGS. 11A-11B, there is shown an additional embodiment of the hinge 11044 and corner post 11032 of the present disclosure. FIG. 11A shows an exploded partial view of the corner post 11032, an "H"-Block 11130 and the hinge 11044 of the present disclosure. As illustrated, the H-Block 11130 can be positioned between J-Bar 11047 and the U-Channel 11049 of the corner post 11032. The H-Block 11130 can be fastened (e.g., welded) to the corner post 11032. Specifically, the H-Block 11130 can be welded to the J-Bar 11047 of the corner post 11032. To accommodate the H-Block 11130 portions of the U-Channel 11049 are removed, where the edges of the U-channel 11049 can abut and, if desired, be welded to the H-Block 11130. H-Blocks 11130 located at the top and bottom of the corner post 11032 can also be welded directly to the top and bottom corner fittings.

When the hinge 11044 is secured to the U-channel 11049, as discussed herein, the H-Block 11130 can help to protect the hinge 11044 from forces (e.g., stacking forces) that are transmitted through the corner post 11032. Specifically, the H-Block 11130 can help to transmit the forces around the hinge 11044. The H-Block 11130 also serves as a seating block for the hinge 11044 (e.g., the hinge 11044 can rest in the opening of the H-Block 11130 on one end and the other end of the H-Block 11130 provides an open space for a locking pin 11138, as discussed herein. As such, the H-Block 11130 can help to protect both the locking pin 11138 and the hinge 11044. The H-Block 11130 also includes notches 11132 that extend in from the legs of the "H," where these notches 11132 help to relieve stresses formed when the freight container is stacked (confirmed by Finite Element Analysis modeling).

Both the U-Channel 11049 and the H-Block 11130 also include a surface 11134 that defines a hole 11136 through the U-Channel 11049 and the H-Block 11130. The hole 11136 is sized to receive and reversibly pass at least a portion of a locking pin 11138. The locking pin 11138 is used to releasably lock the second wing 11003 of the hinge 11044 to both the corner post 11032 and the H-Block 11130. The locking pin 11138 is manipulated from the inside of the freight container.

For the various embodiments, the locking pin 11138 can be positioned through the hole 11136 so as to releasably lock the second wing 11003 of the hinge 11044 to both the corner post 11032 and the H-Block 11130, and removed from the hole 11136 so as to unlock the second wing 11003 of the hinge 11044 from both the corner post 11032 and the H-Block 11130. Specifically, the locking pin 11138 can be retracted from the hole 11136 so as to release the second wing 11003 of the hinge 11044 from the corner post 11032 and the H-Block 11130. Once released, the second wing 11003 can rotate around first hinge pin 11005. To lock the second wing 11003 to the corner post 11032 and the H-Block 11130, the locking pin 11138 is aligned and reinserted though the hole 11136 of the corner post 11032 and the H-Block 11130. As discussed herein, the first wing 11001 can be fastened to the portion of the U channel 11049 and the H-Block 11130 by a welding (e.g., arc-welding) process.

FIG. 11B provides an exploded view of the hinge 11044. As illustrated, the hinge 11044 includes the first wing 11001 and the second wing 11003, where the first wing 11001 and the second wing 11003 are pivotally connected by the first hinge pin 11005. For the various embodiments, the second wing 11003 includes the first planar portion 11007 with the first end 11009 and the second end 11011 and the second planar portion 11013 that extends perpendicular from the first end 11009 of the first planar portion 11007. The first hinge pin 11005 pivotally connects the first wing 11001 to the second end 11011 of the first planar portion 11007. As illustrated, a portion of the first planar portion 11007 of the second wing 11003 passes through an opening defined in the first wing 11001 so as to allow the second end 11011 of the first planar portion 11007 of the second wing 11003 to pivotally connect to the first hinge pin 11005 and the first wing 11001.

The hinge 11044 also includes a pair of hinge lugs 11015 that extend from the second planar portion 11013 of the second wing 11003. Each of the hinge lugs 11015 has a first set of surfaces 11017 defining openings 11019 through which the second hinge pin 11021 passes. For the various embodiments, the first wing 11001 and the second planar portion 11013 of the second wing 11003 include a surface 11140 that defines an opening 11142 through which the locking pin 11138 reversibly travels.

The second planar portion 11013 of the second wing 11003 includes the first major surface 11029 and the second major surface 11031 opposite the first major surface 11029. The pair of hinge lugs 11015 extends from the first major surface 11029 of the second planar portion 11013. The first wing 11001 has the first major surface 11033 and the second major surface 11035 opposite the first major surface 11033. In a first predetermined position the first wing 11001 is perpendicular to the first planar portion 11007 of the second wing 11003 and the first major surface 11033 of the first wing 11001 is directly opposite and parallel with the second major surface 11031 of the second planar portion 11013. As discussed herein, the first predetermined position can occur with the first wing 11001 attached to the corner post 11032 of the freight container and the second wing 11003 of the hinge 11044 positioned against (e.g., adjacent to and in at least partial contact with) the corner post.

The first wing 11001 has a first end 11037 and a second end 11039. The first hinge pin 11005 pivotally connects the first end 11037 of the first wing 11001 to the second end 11011 of the first planar portion 11007 of the second wing 11003. The second planar portion 11013 has an end 11043 that is distal to the first end 11009 of the first planar portion 11007 and the pair of hinge lugs 11015 extending from the second planar portion 11013 have a first peripheral edge 11045, where the end 11043 of the second planar portion 11013 and the first peripheral edge 11045 of the hinge lugs 11015 lay in a common plane.

The hinge 11044 further includes a support block 11150. Support block includes a surface 11152 that defines an opening 11154. Support block 11150 can be positioned against the second planar portion 11013 of the second wing 11003, where the opening 11154 concentrically aligns with the opening 11142 through which the locking pin 11138 travels. Support block 11150 can be welded to the second planar portion 11013 of the second wing 11003. Support block 11150 can also be chamfered so as to allow the door of the freight container to swing unencumbered.

For the various embodiments, the components of the freight container provided herein can be formed of materials suitable for and built so as to comply with ISO standard 1496-1 (fifth edition 1990 Aug. 15) and its amendments, which are all incorporated herein by reference in its entirety. For the various embodiments, the components of the freight container can be formed of steel. Examples of such steel include, but are not limited to, 'weathering steel' as specified within standard BS EN 10025-5:2004, which is also known as CORTEN steel. For the various embodiments, the floor of the freight container can be made of planking wood or plywood.

Although specific examples have been illustrated and described herein, those of ordinary skill in the art will appreciate that an arrangement calculated to achieve the same results can be substituted for the specific examples shown. This disclosure is intended to cover adaptations or variations of one or more examples of the present disclosure. It is to be understood that the above description has been made in an illustrative fashion, and not a restrictive one. Combination of the above examples, and other examples not specifically described herein will be apparent to those of skill in the art upon reviewing the above description. For example, the door assembly of the present disclosure could be used at both ends of the freight container. The scope of the one or more examples of the present disclosure includes other applications in which the above structures and methods are used. Therefore, the scope of one or more examples of the present disclosure should be determined with reference to the appended claims, along with the full range of equivalents to which such claims are entitled.

In Detailed Description, some features are grouped together in a single embodiment for the purpose of streamlining the disclosure. This method of disclosure is not to be interpreted as reflecting an intention that the disclosed examples of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A freight container, comprising:

a roof structure;

a floor structure opposite the roof structure;

sidewall structures between the floor structure and the roof structure, each of the sidewall structures having an exterior surface and an interior surface, where the interior surface at least partially defines a volume of the freight container;

an end frame joined with the roof structure, the floor structure and the sidewall structures, where the end frame has a door sill, a door header and a corner post between the door sill and the door header;

a hinge on the corner post, the hinge having a locking pin, a first wing, a first hinge pin, a second hinge pin, and a second wing, where the first wing is fastened to the corner post, the second wing has a first planar portion with a first end and a second end and a second planar portion that extends perpendicular from the first end of the first planar portion, where the first hinge pin pivotally connects the first wing fastened to the corner post to the second end of the first planar portion;

a pair of hinge lugs extending from the second planar portion, the hinge lugs each having a first set of surfaces defining openings through which the second hinge pin passes and at least one of the pair of hinge lugs having a surface defining an opening through which the locking pin reversibly travels;

a pair of seating blocks fastened to the end frame to form a socket that receives and seats the second planar portion and at least a portion of the pair of hinge lugs, at least one of the pair of seating blocks having a surface defining an opening through which the locking pin travels reversibly to lock and un-lock the second wing from the corner post of the freight container; and a door joined to the pair of hinge lugs with the second hinge pin, where the door pivots on the second hinge pin relative the pair of hinge lugs when the hinge lugs are locked to the corner post of the freight container with the locking pin to allow the door to extend adjacent the exterior surface of the sidewall structure, and where the door and the second wing pivot on the first hinge pin when the hinge lugs are un-locked to the corner post of the freight container to allow the door to travel into the volume of the freight container and extend adjacent the interior surface of the sidewall structure.

2. The freight container of claim 1, where the pair of seating blocks includes a lower seating block and an upper seating block, and the pair of hinge lugs includes a lower hinge lug and an upper hinge lug, where the lower hinge lug seats on the lower seating block and the upper seating block has the surface defining the opening through which the locking pin travels through the opening of the pair of hinge lugs to lock and un-lock the second wing from the corner post of the freight container.

3. The freight container of claim 2, where the lower seating block includes a first surface on which the lower hinge lug seats a second surface substantially perpendicular to the first surface, and a third surface that slopes between the first surface and the second surface, where the lower hinge lug travels along the third surface as the second wing pivots around the first hinge pin relative the first wing.

4. The freight container of claim 2, where the upper seating block includes a first surface, a second surface substantially perpendicular to the first surface, and a third surface that slopes between the first surface and the second surface, where the second planar portion travels along the third surface as the second wing pivots around the first hinge pin relative the first wing.

5. The freight container of claim 1, where each of the lower hinge lug and the upper hinge lug include a surface defining an opening through which the locking pin travels, and each of the lower seating block and the upper seating block include a surface defining an opening through which the locking pin travels to lock and un-lock the second wing from the corner post of the freight container.

6. The freight container of claim 1, where the end frame includes a locking pin travel stop to limit a travel distance of the locking pin.

7. The freight container of claim 1, where the locking pin has a surface defining a structure on which a tool can be used to cause the locking pin to travel.

8. The freight container of claim 1, where the locking pin secures the hinge perpendicular to an axis of rotation of the second hinge pin.

9. The freight container of claim 1, where the door further includes an axle and a wheel, where the wheel is positioned between the door and the floor structure to support and guide the door as the door travels into the volume of the freight container.

10. The freight container of claim 1, including a latch on the sidewall structures, where the latch engages and releasably holds the door adjacent the interior surface of the sidewall structure.

11. The freight container of claim 1, including a locking rod mounted to the door, the locking rod having a first portion and a second portion joined to the first portion with a connection shaft, where the first portion and the second portion telescope relative the connection shaft to change a length of the locking rod.

12. The freight container of claim 11, where the connection shaft has a polygonal cross-sectional shape.

13. The freight container of claim 11, where the locking rod has a handle and each of the first portion and the second portion of the locking rod has a cam, where the cam engages and disengages a cam keeper mounted to the end frame of the freight container as the handle turns the locking rod.

14. The freight container of claim 13, where the locking rod travels past the end frame and the cam keeper as the door travels into the volume of the freight container.

15. The freight container of claim 11, where the door further includes stops that limit the degree of travel of the locking rod.

16. The freight container of claim 1, where the door includes:

a locking rod with a handle and a cam, where the cam engages and disengages a cam keeper mounted to the end frame of the freight container as the handle turns the locking rod; and an anti-racking support extending away from a peripheral edge of the door, where the anti-racking support is directly adjacent the corner post when the cam is engaged with the cam keeper.

17. The freight container of claim 16, where the anti-racking support is directly adjacent both the hinge and the corner post when the cam is engaged with the cam keeper.

18. The freight container of claim 16, where the anti-racking support has a first surface that is directly adjacent the second wing of the hinge and a second surface parallel to the first surface that is directly adjacent a U-channel of the corner post when the cam is engaged with the cam keeper.

19. The freight container of claim 16, where the door further includes an anti-racking block having a tab and a slot to releasably receive the tab, and where the door of the freight container includes a first door and a second door, with the tab extending from the first door and the slot extending from the second door such that the tab seats completely within the slot when the cam of each of the first door and the second door are engaged with their respective cam keeper.

* * * * *